United States Patent [19]

Bert

[11] Patent Number: 4,837,901

[45] Date of Patent: Jun. 13, 1989

[54] END CONNECTOR FOR EXPANSIBLE WATCH BAND

[75] Inventor: Stephen F. Bert, North Scituate, R.I.

[73] Assignee: Textron, Inc.

[21] Appl. No.: 185,920

[22] Filed: Apr. 25, 1988

[51] Int. Cl.[4] ..... A44C 5/14

[52] U.S. Cl. ..... 24/265 B; 24/265 WS; 224/164

[58] Field of Search ..... 224/164, 167, 170, 171, 224/173, 175, 177, 180; 368/281, 282, 283; 63/3, 6, 21, 22; 403/287; 24/265 B, 265 WS, 573; 16/229, 380

[56] References Cited

U.S. PATENT DOCUMENTS

| | | | |
|---|---|---|---|
| 3,675,284 | 7/1972 | Rieth | 24/265 B |
| 3,678,544 | 7/1972 | Bert | 24/265 B |
| 3,707,744 | 1/1973 | Manzo et al. | 24/265 B |
| 3,844,136 | 11/1974 | Rieth et al. | 224/173 |
| 3,897,612 | 8/1975 | Bert | 24/265 B |
| 4,375,713 | 3/1983 | Bert et al. | 224/164 |

*Primary Examiner*—Henry J. Recla
*Assistant Examiner*—Glenn T. Barrett
*Attorney, Agent, or Firm*—Samuels, Gauthier, Stevens & Kehoe

[57] ABSTRACT

An end connector for connecting the ends of an expansible watch band to conventional spring bars or the like carried on a watch case. The end connector is inserted between the endmost top and bottom links of the band and is engageable with the staples providing an interconnection therebetween.

16 Claims, 4 Drawing Sheets

END CONNECTOR FOR EXPANSIBLE WATCH BAND

BACKGROUND OF THE INVENTION

1. Field of the Invention

This invention relates to expansible watch bands, and is concerned in particular with an improved end connector for connecting the ends of such bands to conventional spring bars or the like carried on watch cases.

2. Description of the Prior Art

The conventional expansible watch band typically includes a row of box like top links overlying a row of box like bottom links, with the links of one row being staggered in relation to those of the other row. The top and bottom links are interconnected by pairs of U-shaped staples, with the staples of each pair being located along opposite edges respectively of the band in a mutually confronting relationship. The staples have legs which protrude inwardly into the ends of the links to cooperate with internal springs in providing a means of accommodating longitudinal expansion and contraction of the band. Typically, the top links are covered with ornamental top shells.

in many cases, the endmost top shells are replaced by connectors which match the designs of the top shells and which serve to connect the ends of the bands to spring bars or the like carried on the watch cases. Such connectors have deformable tabs which are bent into engagement with the underlying endmost top links. Where the design of the top shells is relatively plain, e.g., with straight flat sides corresponding to those of the underlying top links, there is ample material available to provide robust tabs at locations selected to optimize the integrity of the resulting connection.

However, in situations where the design of the connectors is more complicated, including for example curved and indented side walls, the formation and/or location of the tabs is often of necessity somewhat compromised. Thus, very precise tab bending becomes critical, for otherwise the connectors may loosen and separate themselves from the band, resulting in loss of the watch.

In order to minimize the chance of this happening, the connectors are factory installed by closely monitored automated tools. Distributors and retailers are cautioned against removing the end connectors. Thus, when the bands require shortening, links are removed at a location intermediate the band ends. This is a complicated and time consuming procedure which entails carefully reassembling staples, internal springs, etc.

A general objective of the present invention is to provide an improved end connector which obviates or at least significantly minimizes the above-described problems and disadvantages associated with the prior art.

A more specific objective of the present invention is to provide an end connector which can be securely and reliably connected to an end of the band, without requiring precise bending of tabs or the like.

Another objective of the present invention is to provide an end connector which has the capability of establishing a secure connection to the endmost top link of the band, regardless of the complexity of design of the connector required to match that of the ornamental top shells.

A related objective of the present invention is the provision of an improved connector which includes a base member located between the endmost top and bottom links in secure interlocked engagement with the endmost pair of interconnecting staples, with a cover member overlying and cooperating in engagement with the endmost top link and the base member to maintain the aforesaid location of the base member.

These and other objects and advantages will become more apparent as the description proceeds with the aid of the accompanying drawings, wherein:

DETAILED DESCRIPTION OF PREFERRED EMBODIMENTS

Figure 1:
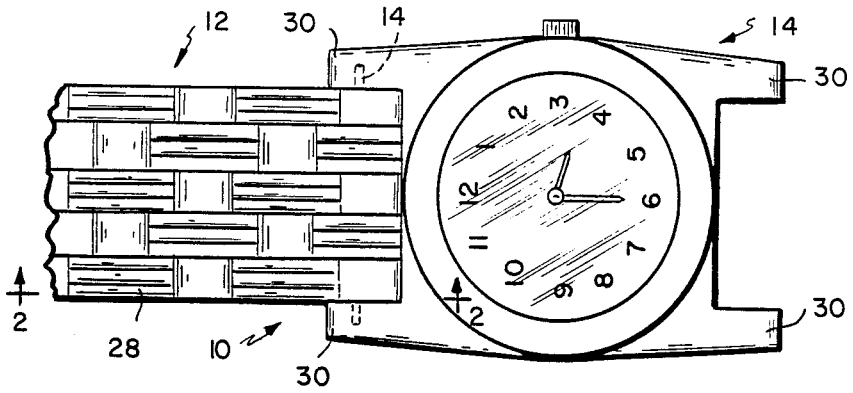
FIG. 1 is a top plan view of a watch band connected to a watch case by means of an end connector in accordance with the present invention.

Referring initially to FIGS. 1–9, an end connector in accordance with one embodiment of the invention is generally depicted at 10 as providing a connection between an expansible watch band 12 and a conventional spring bar 14 or the like carried on a watch case 16.

The expansible band 12 is of the conventional type having a row of box-like top links 18 overlying a row of box-like bottom links 20. The links 18,20 are staggered in relation to each other in the direction of the bracelet length, and are interconnected by pairs of U-shaped staples 22a,22b. The staples of each pair are located along opposite edges respectively of the band, with legs 24 on the staples received in opposite ends of the links 18,20 connected thereby. The staple legs 24 coact with internal springs 26 in a known manner to accommodate resilient longitudinal expansion and contraction of the band 12. Typically, all but the endmost top links 18 are covered by decorative top shells 28. Often, as in the case herein illustrated, the top shells have ornamentally shaped and interlocking side walls.

The watch case 14 may be of any conventional type, having mutually spaced lugs 30 with the spring bar 14 or the like removably secured therebetween. In certain cases, as best shown for example in FIGS. 2 and 5, the spring bar 14 may be contained within a sheath 32 having spring loaded decorative ends (not shown).

The end connector 10 shown in FIGS. 1–9 comprise a base member 34 having a generally planar shank 36. The shank is provided at one end with engagement means in the form of first and second ears **38*a*, 38*b* extending laterally in opposite directions. A hook portion 40 is integrally formed at the opposite end of the shank 36. The hook portion 40 is configured to at least partially surround and engage the spring bar 14 (or as in this case, the sheathe 32 containing the spring bar 14). The shank has side edges 42***a*, 42*b* extending between the hook portion 40 and the ears 38*a*, 38*b*.

Figure 4:
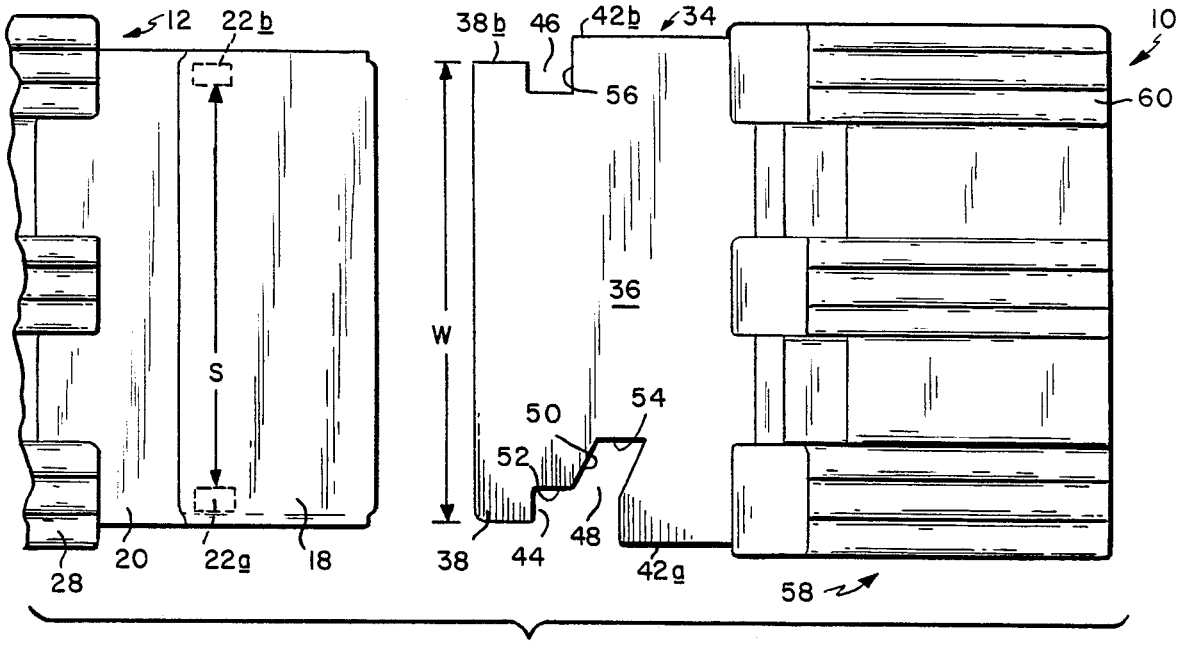
FIG. 4 is an enlarged top plan view showing the end connector separated from the end of the band.

As can best be seen in FIG. 4, the width "W" of the base member 34 measured at the ears 38*a*,38*b* is greater than the spacing "S" between the endmost pair of staples 22*a*,22*b* interconnecting the endmost top and bottom links 18,20 of the band. The shank 36 is dimensioned for insertion between the endmost top and bottom links, and the side edges 42*a*, 42*b* are appropriately configured to accommodate manipulation of the thus inserted shank in its plane in directions required to position the ears 38*a*,38*b* respectively behind the endmost staples 22*a*, 22*b*.

More particularly, it will be seen that the side edges 42*a*, 42*b* respectively have first and second staple-receiving notches 44, 46 respectively located adjacent to and immediately inboard of the first and second ears 38*a*, 38*b*. A third notch 48 is located adjacent to and inboard of the first notch 44. The third notch 48 has a depth greater than the depth of the first notch 44. The third notch 48 is at least partially defined by a camming edge 50 which extends angularly inwardly towards the center of the shank from the base 52 of the first notch 44 to the base 54 of the third notch 48. The second notch 46 is at least partially defined by a stop edge 56 which extends laterally outwardly beyond the second ear 38*b*.

Figure 2:
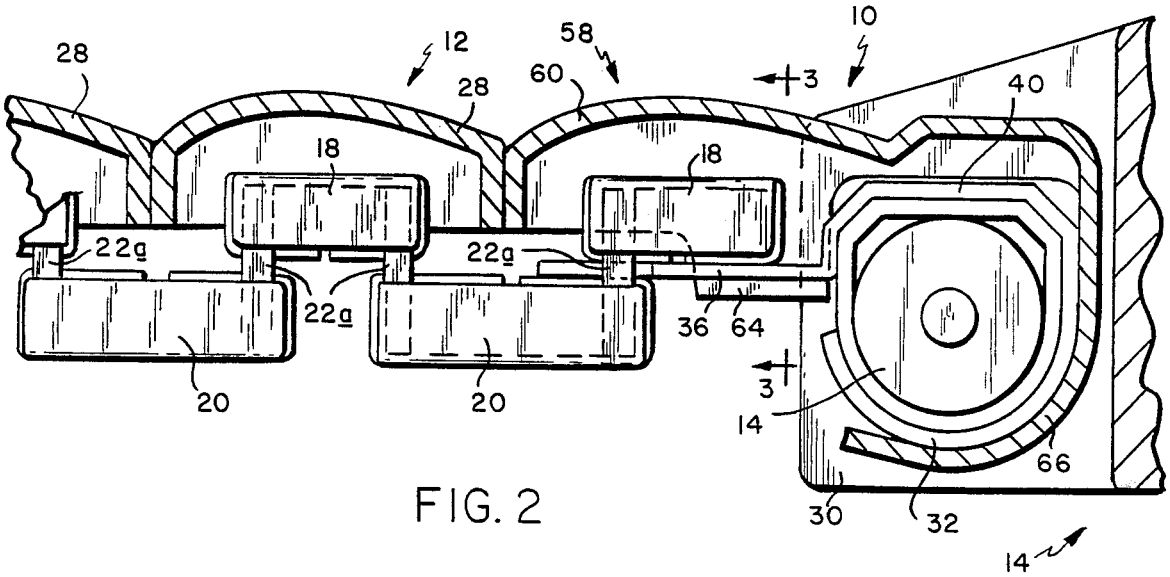
FIG. 2 is a sectional view on an enlarged scale taken along line 2—2 of FIG. 1.
Figure 3:
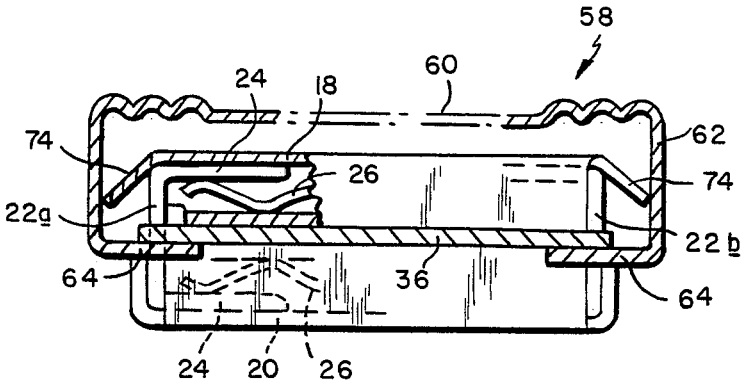
FIG. 3 is a sectional view taken along line 3—3 of FIG. 2.
Figure 5:
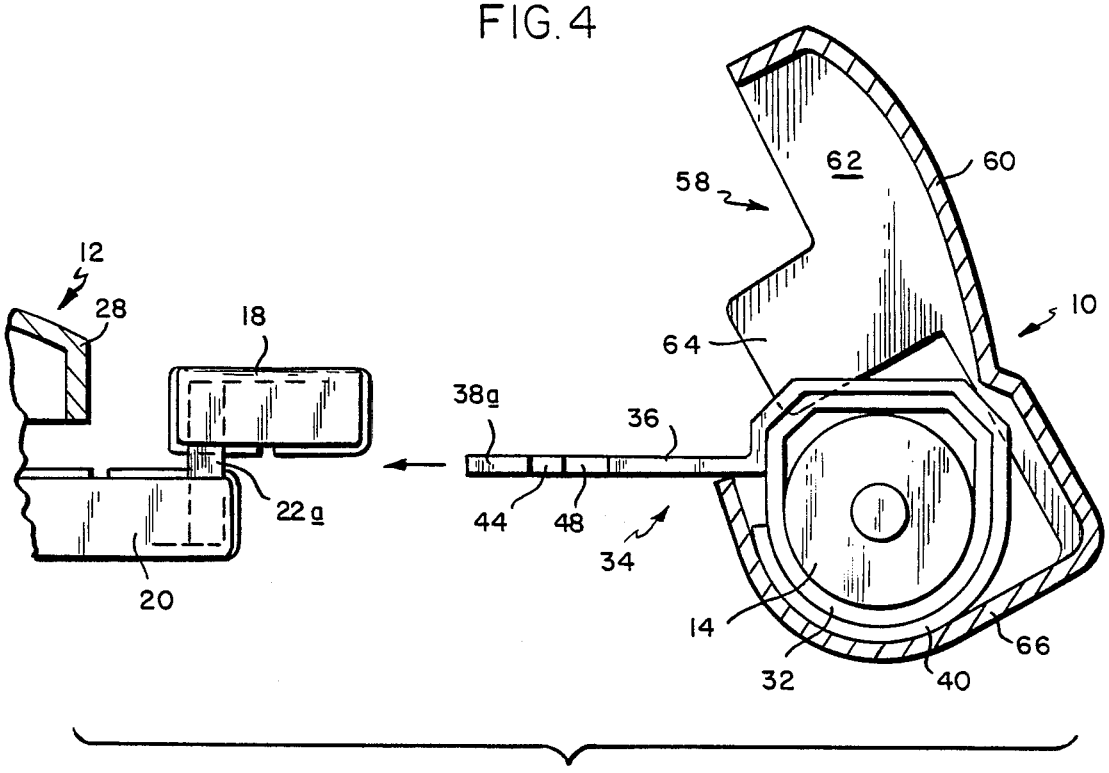
FIG. 5 is a side view of the components shown in FIG. 4.

The end connector 10 further includes a cover member 58 having a cap portion 60 with side walls 62. The side walls 62 have bendable side tabs 64 extending downwardly therefrom. A nose portion 66 is shaped to partially surround and engage the hook portion 40 of the base member. In the embodiment of FIGS. 1–9, the cover member and base member are integrally combined, with the cover member being rotatable relative to the base member about the axis of the spring bar 14 between an open position as shown in FIGS. 4 and 5 and a closed position as shown in FIGS. 1–3.

Figure 6:
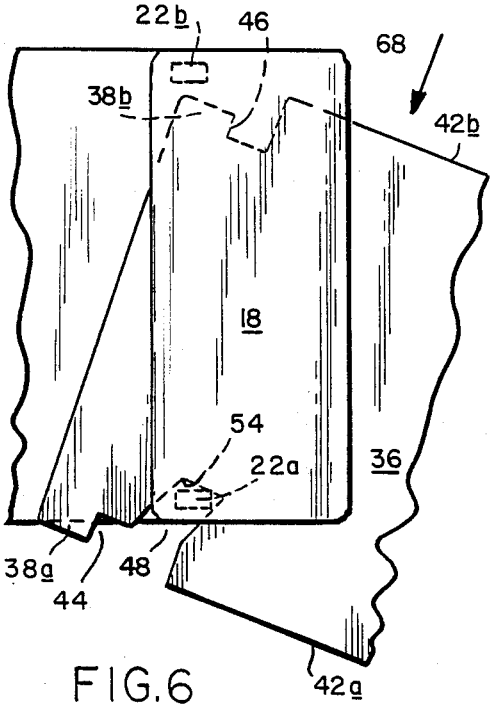
FIGS. 6–9 are somewhat schematic illustrations depicting the steps involved in assembling the end connector to the end of the band.
Figure 7:
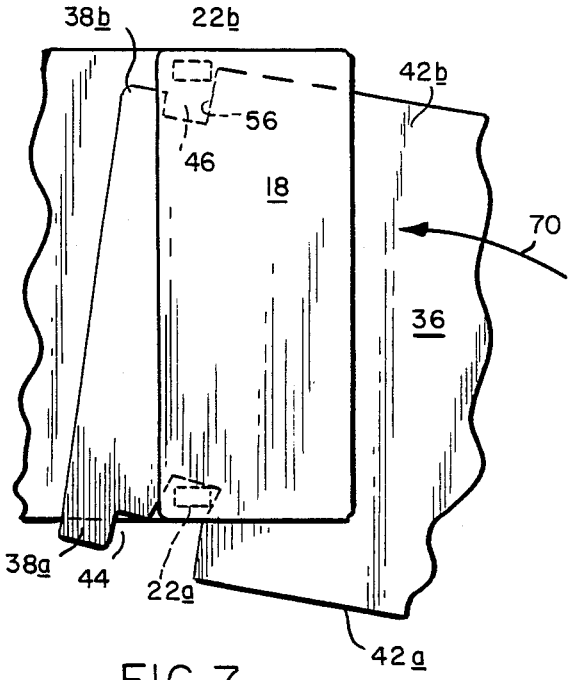
Figure 8:
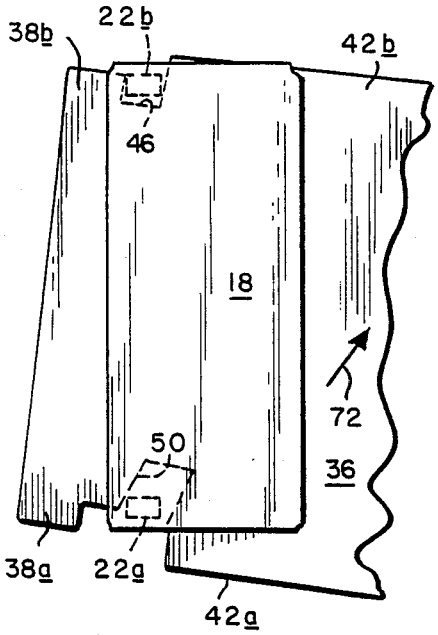
Figure 9:
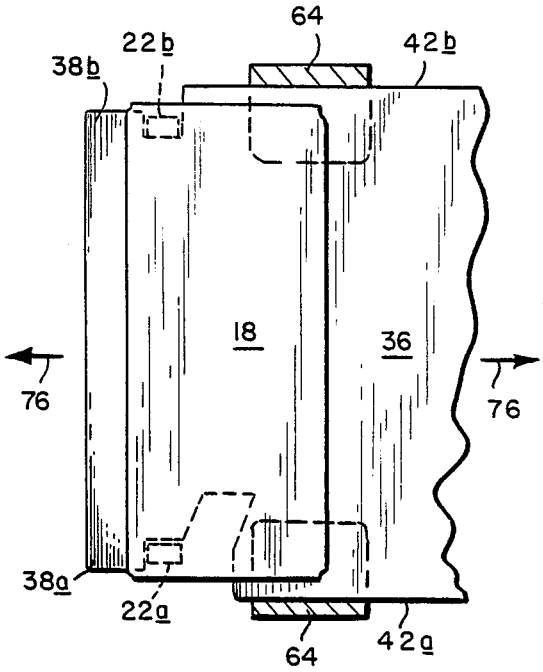

The manner of connecting the base member 34 to the band end will now be described. The cover member 58 is first opened to the position shown in FIGS. 4 and 5. Then, as illustrated in FIG. 6, the shank 36 is inserted in the direction of arrow 68 between the endmost top and bottom links. In so doing, the endmost staple 22*a* is received in the third notch 48 against the base 54 thereof. Next, as shown in FIG. 7, the shank 36 is rotated about the staple 22*a* in the direction of arrow 70 to thus bring the stop edge 56 of the second notch 46 against the other endmost staple 22*b*. Then, as shown in FIG. 8, the shank and band are separated, causing the shank to shift in relation to the band in the direction of arrow 72 as the camming edge 50 slides across staple 22*a*. As this shifting progresses, the other staple 22*b* gradually enters the second notch 46 and the shank gradually moves into longitudinal alignment with the band, as shown in FIG. 9. At this point, the ears 38*a*, 38*b* are respectively located behind and in interlocked engagement with the staples 22*a*, 22*b*.

Once the shank 36 is located in longitudinal alignment with the band between the endmost top and bottom links 18,20, with the ears 38*a*, 38*b* securely interlocked behind their respective endmost staples 22*a*, 22*b*, the cover member 58 is rotated to the closed position shown in FIGS. 1–3. The endmost top link 18 is then hidden beneath the cap portion 60, which is decoratively shaped to match the appearance of the top shells 28. As can be best seen in FIG. 3, the sidewalls 62 of the cap portion contact angular end flaps 74 on the top link 18, thereby preventing lateral shifting of the end connector relative to the band. The side tabs 64 are then bent under the shank 36 to complete the attachment of the end connector to the band.

It will be seen, therefore, that the end connector is securely attached to the end of the band by virtue of the interengagement of the ears 38*a*, 38*b* behind the staples 22*a*, 22*b*. In order to achieve this, the shank must undergo some shifting relative to the band in the direction of arrow 72 (FIG. 8). Once the cover member 58 is closed, any shifting of the shank in a direction opposite to that of arrow 72 is precluded by the containment of the side flaps 74 on the top link 18 between the side walls 62 of the cap portion. The bending of the tabs 64 beneath the shank 36 merely serves to hold the cover in the closed position. Separating forces in the direction of arrows 76 in FIG. 9 will be resisted by the interengagement of the ears 38*a*, 38*b* and staples 22*a*, 22*b*. The bendable tabs 64 are effectively isolated from such separating forces. Thus, even if the bending of the tabs 64 is less than precise, the integrity of the attachment of the end connector to the band will not be compromised as long as the cover member is held in the closed position.

Figure 10:
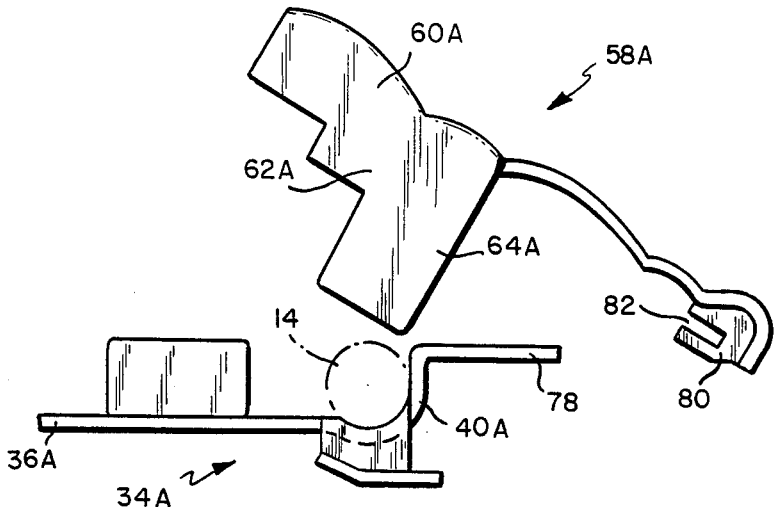
FIG. 10 is a side view showing an alternate embodiment of an end connector partially assembled onto the end of a watch band.
Figure 11:
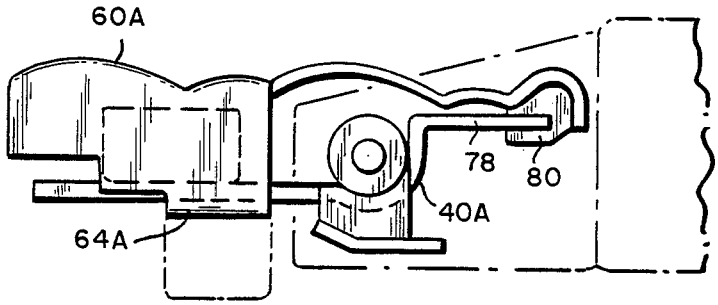
FIG. 11 is a view similar to FIG. 10 showing the end connector in its fully assembled and interconnected with the band end.

In the embodiment shown in FIGS. 10 and 11, the base member 34A and cover member 58A comprise separable components. The base member has a shank 36A and laterally protruding ears (not shown) which are identical to those previously described in connection with the embodiment of FIGS. 1–9. The manner of connecting the base member 34A to the band end is identical to that described in FIGS. 6–9. However, the hook portion 40A of base member 34A is arranged to underlie the spring bar 14, with a flange 78 protruding rearwardly therefrom.

The cover member 58A again has a cap portion 60A and side walls 62A with downwardly protruding bendable tabs 64A. The nose portion 66A is provided with side walls 80 having notches 82. When the cover member 58A is assembled onto the base member 34A in a closed position as illustrated in FIG. 11, the notches 82 engage the flange 78, and the tabs 64A are again bent to underlie the shank 36A.

I claim:

1. For use in combination with an expansible watch band of the type having top and bottom links interconnected by pairs of U-shaped staples, the staples of each pair being located along opposite edges respectively of the band in a mutually spaced confronting relationship, with legs on the staples received in opposite ends of the links interconnected thereby, a connector for connecting an end of the band to a spring bar or the like carried on a watch case, said connector comprising: a base member having a generally planar shank with engagement means at one end thereof for engagement with the end most pair of staples interconnecting the endmost top and bottom links of the band to prevent separation of the base member from the band, a hook portion at the opposite end thereof, and with side edges extending along said shank from said hook portion to said engagement means, wherein the width of said base member at said engagement means is greater than the spacing between the endmost pair of staples interconnecting the endmost top and bottom links of the band, said shank being dimensioned for insertion between said endmost top and bottom links and said side edges being configured to accommodate manipulation of the thus inserted shank in the plane of said shank in directions required to position said engagement means behind said endmost pair of staples, with separation of said base member from the band being prevented by engagement of said endmost staples with the thus positioned engagement means and the side edges of the thus inserted shank, said hook portion being configured to engage the spring bar, and a cover member overlying and engageable with said endmost top link and the thus inserted shank in a manner preventing reverse manipulation of said shank in directions opposite to said first mentioned directions.

2. The connector of claim 1 wherein said engagement means comprises first and second ears extending laterally in opposite directions from said shank.

3. The connector of claim 2 wherein said side edges are configured to provide first and second staple-receiving notches respectively located adjacent to said first and second ears.

4. The connector of claim 3 further comprising a third notch located adjacent to and having a depth greater than that of said first notch.

5. The connector of claim 4 wherein said third notch is at least partially defined by a camming edge.

6. The connector of claim 5 wherein said camming edge extends angularly inwardly towards the center of said shank from the base of said first notch to the base of said third notch.

7. The connector of claim 6 wherein said second notch is at least partially defined by stop edge.

8. The connector of claim 7 wherein said stop edge extends laterally outwardly beyond said second ear.

9. The connector of claim 7 wherein the depth of said third notch is such that said shank is inserted between said endmost top and bottom links with one of said endmost staples seated against the base of said third notch, said second ear is located inwardly of the other of said staples, thereby permitting said base member to be rotated in the plane of said shank about the said one endmost staple to an intermediate position at which the other of said endmost staples in in contact with said stop edge and spaced laterally outwardly from the base of said second notch.

10. The connector of claim 9 wherein in response to movement of the intermediately positioned base member away from said band in the direction of the longitudinal band axis, said camming edge will contact and move across said one endmost staple, with an accompanying lateral shifting of said shank to a position at which said endmost staples are seated respectively in said first and second notches in engagement with said first and second ears.

11. The connector of claim 1 wherein said cover member is connected to said hook portion.

12. The connector of claim 11 wherein said cover member is rotatable relative to said base member about the axis of said spring bar.

13. The connector of any one of claims 1, 11 or 12 wherein said cover member is integrally connected to said base member.

14. The connector of claim 1 wherein said cover member is separably connected to said base member.

15. The connector of claim 14 wherein said hook portion includes a flange, and wherein said cover member is engageable with said flange.

16. The end connector of claim 1 wherein said cover member is adjustable between an open position permitting said reverse manipulation, and a closed position preventing said reverse manipulation, said cover member having deformable tab means engageable with said shank to retain said cover member in said closed position.

* * * * *